US005128309A

United States Patent [19]

Iwakura et al.

[11] Patent Number: 5,128,309

[45] Date of Patent: Jul. 7, 1992

[54] RECORDING MATERIAL

[75] Inventors: Ken Iwakura; Koreshige Ito; Shojiro Sano, all of Shizuoka, Japan

[73] Assignee: Fuji Photo Film Co., Ltd., Kanagawa, Japan

[21] Appl. No.: 557,352

[22] Filed: Jul. 25, 1990

[30] Foreign Application Priority Data

Jul. 26, 1989 [JP] Japan ..... 1-192890

[51] Int. Cl.[5] ..... B41M 5/155; B41M 5/32

[52] U.S. Cl. ..... 503/209; 503/208; 503/212; 503/216

[58] Field of Search ..... 427/15 D, 151; 503/210-212, 216, 225, 208, 209, 226

[56] References Cited

U.S. PATENT DOCUMENTS 4,379,721 4/1983 Qualitz et al. ..... 106/21

FOREIGN PATENT DOCUMENTS 62-216786 9/1987 Japan ..... 503/216

*Primary Examiner*—Bruce H. Hess

*Attorney, Agent, or Firm*—Sughrue, Mion, Zinn, Macpeak & Seas

[57] ABSTRACT

A recording material containing an electron donating colorless dye capable of undergoing a coloration reaction, wherein a metal salt of a salicylic acid derivative represented by the following formula (I) and a fatty acid derivative having a benzotriazole group as a substituent group or an alcohol derivative having a benzotriazole group as a substituent group are provided on a same support:

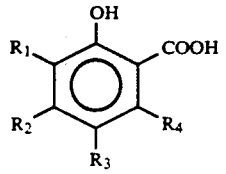

(I)

wherein $R_1$, $R_2$, $R_3$ and $R_4$ represent each hydrogen atom, an alkyl group or an aryl group.

5 Claims, No Drawings

RECORDING MATERIAL

FIELD OF THE INVENTION

This invention relates to a recording material, and more particularly to a recording material which has improved color-forming ability and improved stability of image area and non-image area.

BACKGROUND OF THE INVENTION

Recording materials using electron donating colorless dyes and electron accepting compounds are well known. For example, the recording materials are fully described in U.K. Patent 2,140,440, U.S. Pat. Nos. 4,480,052 and 4,436,920 and JP-A-62-144989 (the term "JP-A" as used herein means an "unexamined published Japanese patent application").

Recording materials have been extensively studied to improve their characteristics such as (1) color density and color sensitivity, and (2) fastness of colored images in recent years.

The present inventors have paid attention to the characteristics of the electron donating colorless dyes and the electron accepting compounds such as solubility in oil and water, partition coefficient, pKa, the polarity of substituents, the positions of substituents, the crystallizability of mixtures and the change of solubility, and have investigated to develop good materials for recording materials and good recording materials.

SUMMARY OF THE INVENTION

An object of the present invention is to provide a recording material which has good color-forming ability, and gives good color image and stable non-image area, and which is obtained from a material meeting all of requirements for the recording material.

The above-described object of the present invention has been achieved by providing a recording material containing an electron donating colorless dye capable of undergoing a coloration reaction, wherein a metal salt of a salicylic acid derivative represented by the following formula (I) and a fatty acid derivative having a benzotriazole group as a substituent group or an alcohol derivative having a benzotriazole group as a substituent group are provided on a same support:

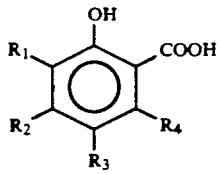

(I)

wherein $R_1$, $R_2$, $R_3$ and $R_4$ represent each hydrogen atom, an alkyl group or an aryl group.

DETAILED DESCRIPTION OF THE INVENTION

Now, the present invention will be illustrated in more detail below.

In formula (I), groups represented by $R_1$, $R_2$, $R_3$ and $R_4$ may be optionally substituted by one or more substituent groups of an alkyl group, an alkenyl group, an aryl group, a hydrogen atom, an alkoxy group, an aryloxy group, an alkylthio group, a halogen atom, a nitro group, cyano group, a heterocyclic group, etc. These substituent groups may be further substituted. Preferred examples of the groups represented by $R_1$, $R_2$, $R_3$ and $R_4$ include a hydrogen atom, an alkyl group having 1 to 20 carbon atoms, an aralkyl group having 7 to 20 carbon atoms, and an aryl group having 6 to 20 carbon atoms. Particularly preferred are a hydrogen atom, an alkyl group having 1 to 20 carbon atoms and an aralkyl group having 7 to 20 carbon atoms.

Preferred examples of the metal salt of the salicylic acid derivative which can be used in the present invention include zinc salt, aluminum salt, magnesium salt, potassium salt, sodium salt and nickel salt with zinc salt being particularly preferred.

Examples of the salicylic acid derivative of the present invention include, but are not limited to, 3,5-bis(α-methylbenzyl)salicylic acid, 3-(1 benzylphenylethyl)-salicylic acid, 3-(1-methyl-1-ethylpentyl)-5-α,α-dimethylbenzylsalicylic acid, 3-α,α-dimethylbenzyl-5-t-octylsalicylic acid, 3-α,α-dimethylbenzyl-5-t-butylsalicylic acid, 3-t-butyl-5-α,α-dimethylbenzylsalicylic acid, 3,5-di-t-butylsalicylic acid, 3,5-di-t-octylsalicylic acid, 3,5-di-t-nonylsalicylic acid, 3,5-bis-(α,α-dimethyltolylmethyl)salicylic acid, 3,5-bis(α,α-dimethylbenzyl)salicylic acid, 3-α-methylbenzyl-6-methylsalicylic acid, 3-(1-benzylphenylethyl)-6-methylsalicylic acid, 3-(1-methyl-1-ethylpentyl)-6-methylsalicylic acid, 3,5-bis(1-benzylphenylethyl)salicylic acid, 3,5-bis(benzylphenylmethyl)salicylic acid, 3,5-bis-(α-methylbenzyl)-6-methylsalicylic acid, 3-(1-tolylethyl)-6-methylsalicylic acid, 3,5-bis(α,α-dimethylbenzyl)-6-methylsalicylic acid, 3,5-di-t-octyl-6-methylsalicylic acid, 3-(1-dimethylphenylethyl)-6-methylsalicylic acid, 3-(1-ethyl-1-phenylethyl)-6-methylsalicylic acid, 3-(1-isopropyl 1 phenylethyl)-6-methylsalicylic acid, 3-{1-benzylphenylmethylphenyl) ethyl}-6-methylsalicylic acid, 3-(1-methyl-1-ethylpentyl)-6-ethylsalicylic acid, 3-t-dodecylsalicylic acid, 3-t-dodecyl-5-methylsalicylic acid, 3-t-dodecyl-5-t-butylsalicylic acid, 3-sec-dodecylsalicylic acid, and 3-sec-tetradecylsalicylic acid.

The salicylic acid derivatives of the present invention can be easily synthesized from the corresponding phenol derivatives by Kolbe-Schmitt reaction.

Fatty acid derivatives having benzotriazole group as a substituent group or alcohol derivatives having benzotriazole group as a substituent group are preferably compounds represented by formulas (II) and (III):

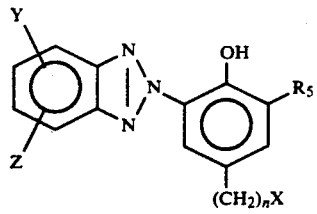

(II)

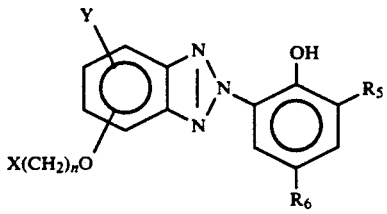

(III)

wherein n is an integer of 2 to 10; X is —COOH, —OH or —$COOC_mH_{2m-1}(OH)_2$ (wherein m is an integer of 3 to 10); Y and Z are each a hydrogen atom, an alkyl group, an alkoxy group, an aryloxy group, a halogen atom, a substituted amino group, a cyano group, a nitro group, an acyl group or a trihalomethyl group, preferably a hydrogen atom, an alkyl group having 1 to 4 carbon atoms or a halogen atom; and $R_5$ and $R_6$ are each a tertiary alkyl group, preferably having 4 to 12 carbon atoms.

Typical examples of the fatty acid derivatives having benzotriazole group as a substituent group or the alcohol derivatives having benzotriazole group as a substituent group include 3-{5-t-butyl-3-(5-chloro-2H-benzotriazole-2-yl)-4-hydroxyphenyl}propionic acid, 3-{5-t-butyl-3-(5-chloro-2H-benzotriazole-2-yl)-4-hydroxyphenyl}propanol, [2-{5-t-butyl-3-(5-chloro-2H-benzotriazole-2-yl)-4-hydroxyphenyl}ethylcarbonyloxy]-propanol, 3-{5-t-butyl-3-(2H-benzotriazole-2-yl)-4-hydroxyphenyl}propionic acid, 3-{5-t-butyl-3-(2H-benzotriazole-2-yl)-4-hydroxyphenyl}propanol, 6-[2-{5-t-butyl-3-(2H-benzotriazole-2-yl)-4-hydroxyphenyl}ethylcarbonyloxy]hexanol and 3-[2-{5-t-butyl-3-(2H-benzotriazole-2-yl)-4-hydroxyphenyl}ethylcarbonyloxy]propylene glycol. However, compounds which can be used in the present invention are not limited to those emplified above, and other compounds can be used.

The metal salt of the salicylic acid derivative and the fatty acid derivative having benzotriazole group as a substituent group or the alcohol derivative having benzotriazole group as a substituent group according to the present invention may form an adduct thereof. The adduct can be easily synthesized by melt-mixing the metal salt of the corresponding salicylic acid derivative with the fatty acid derivative having benzotriazole group as a substituent group or the alcohol derivative having benzotriazole group as a substituent group without using any solvent, or mixing them with each other in a solvent and then removing the solvent.

The recording material of the present invention may contain the compounds of the present invention in combination with other compounds such as phenolic derivative, salicylic acid derivative, a metal salt of aromatic carboxylic acid, terra abla, bentonite, novolak resin, metal-treated novolak resin or metal complex which are known by those in the art. Examples of these compounds are described in JP-B-40-9309 (the term "JP-B" as used herein means an "examined Japanese patent publication"), JP-B-45-14039, JP-A-52-140483, JP-A-48-51510, JP-A-57-210886, JP-A-58-87089, JP-A-59-11286, JP-A-60-176795 and JP-A-61-95988.

Examples of the electron donating colorless dye which can be used in the present invention include various compounds such as triphenylmethane phthalide compounds, fluoran compounds, phenothiazine compounds, indolylphthalide compounds, leuco Auramine compounds, Rhodamine lactam compounds, triphenylmethane compounds, triazene compounds, spiro-pyran compounds and fluorene compounds.

Examples of the phthalide compounds are described in U.S. Pat. No. Re. 23,024, U.S. Pat. Nos. 3,491,111, 3,491,112, 3,491,116 and 3,509,174. Examples of the fluoran compounds are described in U.S. Pat. Nos. 3,624,107, 3,627,787, 3,641,011, 3,462,828, 3,681,390, 3,920,510 and 3,959,571. Examples of the spiro-pyran compounds are described in U.S. Pat. No. 3,971,808. Examples of pyridine and pyrazine compounds are described in U.S. Pat. Nos. 3,775,424, 3,853,869 and 4,246,318. Examples of the fluorene compounds are described in JP-A-63-94878.

In the recording material of the present invention, the electron accepting compound as color developer is used in an amount of preferably 50 to 5000% by weight, more preferably 100 to 2000% by weight, based on the amount of the electron donating colorless dye. The amount of the salicylic acid derivative of the present invention accounts for preferably not less than 10% by weight, particularly preferably not less than 20% by weight of the total amount of the electron accepting compound.

These electron accepting compounds are used in the form of fine dispersions to fine droplets or a film when applied to the recording material.

Further, the recording material may contain various additives such as pigment, wax, antistatic agent, ultraviolet light absorber, anti-foaming agent, electrically conducting agent, fluorescent dye and surfactant which are conventionally used as additives in the fields of recording materials and high-molecular resins.

When they are used for pressure-sensitive paper, there may be used various forms described in prior patent specifications such as U.S. Pat. Nos. 2,505,470, 2,505,471, 2,505,489, 2,548,366, 2,712,507, 2,730,456, 2,730,457, 3,103,404, 3,418,250 and 4,010,038. Most generalized form is composed of at least a pair of sheets wherein the electron donating colorless dye and the electron accepting compound are separately contained.

Methods for preparing capsules include a method using the coacervation of hydrophilic colloid sol described in U.S. Pat. Nos. 2,800,457 and 2,800,458; interfacial polymerization method described in U.K. Patents 867,797, 950,443, 989,264 and 1,091,076; and a method described in U.S. Pat. No. 3,103,404.

Generally, the electron donating colorless dyes singly or in a mixture of two or more of them are dissolved in a solvent (e.g., synthetic oil such as alkylated naphthalene, alkylated diphenyl, alkylated diphenylmethane, alkylated terphenyl or chlorinated paraffin; vegetable oil such as cottonseed oil or castor oil; animal oil; mineral oil; or mixed oil thereof), the resulting solution is enclosed in microcapsules and the resulting microcapsule solution is coated on a support such as paper, wood free paper, plastic sheet or resin-coated paper to prepare a color former sheet.

The electron accepting compounds singly or in a mixture of two or more of them and optionally additives are mixed, the mixture is dispersed in a binder such as styrene-butadiene latex or polyvinyl alcohol and the resulting dispersion together with pigment is coated on a support such as paper, plastic sheet or resin-coated sheet to obtain a developer sheet.

Preferably, carboxyl-modified styrene-butadiene latex and a water-soluble high-molecular material are used in a ratio of 50:50 to 25:75 by weight as the binder.

As the carboxyl-modified styrene-butadiene latex, an unsaturated acid-modified product is preferred. Particularly, an acid such as acrylic acid, methacrylic acid, maleic acid or itaconic acid-modified product is preferred.

Examples of the water-soluble high-molecular material which can be used in the present invention include synthetic and natural high-molecular materials such as polyvinyl alcohol, maleic anhydride-isobutylene copolymer, carboxymethyl cellulose, hydroxyethyl cellulose, polyacrylamide, polyacrylic acid, polyvinyl pyrrolidone, starch, casein, gum arabic and gelatin.

When the ratio of the carboxyl-modified styrene-butadiene latex to be used exceeds 50%, the light resistance of colored material and the yellow modification of surface developed by light are deteriorated, while when the ratio of the carboxyl-modified styrene-butadiene latex to be used is lower than 25%, the water resistance of developed surface is deteriorated.

Examples of the pigment include zinc oxide, aluminum hydroxide, calcium carbonate, titanium oxide, magnesium carbonate, magnesium oxide, barium sulfate, kaolin, terra abla and talc.

It is particularly preferred that calcium carbonate having an average particle size of not larger than 5.0μ is used in such a proportion that the amount of said calcium carbonate accounts for at least 60% by weight of the total amount of the entire pigment. When the amount of calcium carbonate to be used is less than 60% by weight, satisfactory performance with regard to the light resistance of colored material and the yellow modification of developed surface cannot be obtained. Further, when calcium carbonate having an average particle size of not larger than 5.0μ is not used, sufficient developing performance cannot be obtained. Calcium carbonate having an average particle size of not larger than 5.0μ is commercially available under trade names of Brilliant-15, Brilliant-S15, Brilliant-30, PC, PCX and Unibur-70 (products of Shiraishi Kogyo KK).

Preferably, the electron accepting compound and the pigment are used in a ratio of 1:5 to 1:15 by weight. When the ratio of the pigment to be used is higher or lower than the above ratio, sufficient developing performance cannot be obtained.

The electron accepting compound and the pigment together with dispersant, water-soluble high-molecular material and other additives are subjected to a dispersion treatment in water mechanically in a ball mill, an attritor or a sand mill, whereby a dispersion can be obtained. A part of the electron accepting compound can be used in the form of an emulsion by dissolving it in an organic solvent and emulsifying the resulting solution in water.

The amount of the electron accepting compound to be coated on the support is 0.1 to 2.0 g/m$^2$, preferably 0.2 to 1.0 g/m$^2$.

The amount of the electron donating colorless dye to be used may be determined according to coating thickness, the shape of pressure-sensitive recording paper, the method for preparing capsules and other conditions. The amount of the electron donating colorless dye to be used can be easily determined by those skilled in the art.

When used for light and pressure-sensitive paper, there may be various forms described in prior patent specifications such as U.S. Pat. Nos. 4,399,209, 4,551,407, 4,440,846, 4,536,463, 4,800,149 and 4,772,530.

When used for heat-sensitive paper, forms described in JP-A-62-144989 and JP-A-1-87291 may be used. More specifically, the electron donating color-less dye and the electron accepting compound are crushed in a dispersion medium to a particle size of not larger than 10μ, preferably not larger than 3μ. As the dispersion medium, a 0.5 to 10% aqueous solution of a water-soluble high-molecular material is generally used and dispersion is carried out by using a ball mill, a sand mill, a horizontal type sand mill, attritor or a colloidal mill.

The electron donating colorless dye and the electron accepting compound are used in a ratio of preferably 1:10 to 1:1, more preferably 1:5 to 2:3 by weight.

A thermal fusible material may be incorporated in the heat-sensitive color forming layer to improve thermal response. Typical examples of the thermal fusible material include aromatic ethers, thioethers, esters, aliphatic amides and ureides.

More specifically, examples of these compounds are described in JP-A-58-57989, JP-A-58-87094, JP-A-61-58789, JP-A-62-109681, JP-A-62-132674, JP-A-63-151478, JP-A-63-235961, Japanese Patent Application Nos. 1-4447 and 1-37070.

These thermal fusible materials are finely dispersed simultaneously with the electron donating colorless dye or the electron accepting compound. These compounds are used in an amount of at least 20% by weight, but not more than 300% by weight, preferably not less than 40%, but not more than 150% by weight, based on the amount of the electron accepting compound.

Additives are added to the thus-obtained coating solution to meet various requirements. For example, an inorganic pigment, an oil absorbing material such as polyurea filler, etc. are dispersed in the binder to prevent recording heads from being stained during recording. A fatty acid, metallic soap, etc. are added to improve releasability from the head. Accordingly, additives such as the thermal fusible material, the pigment, the wax, the antistatic agent, the ultraviolet light absorber, the anti-foaming agent, the electrically conductive agent, the fluorescent dye, the surfactant, etc. in addition to the electron donating colorless dye and the electron accepting compound which participate directly in color formation are coated on the support to obtain a recording material.

The resulting heat-sensitive coating solution is coated on a support such as wood free paper with or without an undercoat layer, synthetic paper or a plastic film. It is particularly preferred from the viewpoint of dot reproducibility that a support having a degree of smoothness of 500 seconds or above, particularly 800 seconds or above according to JIS-8119 standard is used.

The present invention is now illustrated in greater detail by reference to the following examples which, however, are not to be construed as limiting the invention in any way. In the examples, parts and percents are by weight unless otherwise indicated.

EXAMPLE 1

(1) Preparation of electron donating colorless dye-containing capsule sheet

5 Parts of partial sodium salt of polyvinylbenzenesulfonic acid (VERSA, TL500 manufactured by National Starch) was dissolved in 95 parts of hot water. The resulting solution was cooled and the pH thereof was adjusted to 4.0 by adding an aqueous solution of sodium hydroxide. 100 parts of diisopropylnaphthalene containing 4.5% of 3-(2-ethoxy-4-diethylaminophenyl)-3 (1-octyl-2-methylindole-3-yl)phthalide as the electron donating colorless dye dissolved therein was emulsified and dispersed in 100 parts of the above 5% aqueous solution of partial sodium salt of polyvinylbenzenesulfonic acid to obtain an emulsion having a particle size of 4.0μ in diameter. Separately, 6 parts of melamine, 11 parts of an aqueous solution of 37 wt % formaldehyde and 30 parts of water were heated at 60° C. with stirring. After 30 minutes, an aqueous solution of a transparent melamine-formaldehyde prepolymer was obtained. This aqueous solution was mixed with said emulsion. While stirring, the pH of the mixture was adjusted with 2M phosphoric acid solution to 6.0. The temperature of the solution was elevated to 65° C. and stirring was continued for 6 hours. The resulting capsule solution was cooled to room temperature, and the pH thereof was adjusted with an aqueous solution of sodium hydroxide to 9.0.

To the dispersion, there were added 200 parts of an aqueous solution of 10 wt % polyvinyl alcohol and 50 parts of starch granules. Water was added thereto to adjust the solid content of the microcapsule dispersion, thus obtaining a solution containing solids at a concentration of 20%.

Base paper having a basis weight of 50 g/m$^2$ was coated with the resulting coating solution by means of air knife coater in such an amount as to give a coating weight of 5 g of m$^2$ on a solid basis. The coated paper was dried to obtain an electron donating colorless dye-containing capsule sheet.

(2) Preparation of electron accepting compound sheet

A dispersion consisting of 14 parts of an equimolar adduct of zinc 3,5-bis(α-methylbenzyl) salicylate and 3-{5-t-butyl-3-(2H-benzotriazole-2-yl)-4-hydroxyphenyl}propionic acid, 80 parts of calcium carbonate having an average particle diameter of not larger than 5.0μ, 20 parts of zinc oxide, 1 part of sodium hexametaphosphate and 200 parts of water was dispersed in a sand grinder so as to give an average particle diameter of 3μ. To the resulting dispersion, there were added 100 parts of a 10% aqueous solution of PVA and 10 parts (on a solid basis) of carboxyl-modified SBR latex. Water was added thereto to adjust the solid content of the dispersion to 20%, thus obtaining a coating solution. Base paper having a basis weight of 50 g/m$^2$ was coated with the coating solution by means of air knife coater in such an amount as to give a coating weight of 5.0 g/m$^2$ on a solid basis. The coated paper was dried to obtain an electron accepting compound sheet.

The surface of the electron donating colorless dye-containing capsule sheet was put on the electron accepting compound sheet. A load of 400 kg/cm$^2$ was applied thereto to develop color. The spectral absorption of the colored image in the wavelength region of 400 to 780 nm was measured. A density at absorption maximum was measured. Color density was 1.02.

The developer sheet was irradiated for 20 hours by using a fluorescent light fadeometer (33,000 lux) to examine the change of the developer sheet obtained in the above item (2) by light. The density of the developer sheet was measured and it was found that the density was 0.10. Further, color was developed by using the developer sheet. Color density was 0.98.

EXAMPLE 2

An electron donating colorless dye-containing microcapsule sheet was obtained in the same way as in Example 1 except that Crystal Violet Lactone was used as the electron donating colorless dye. Color was developed in the same way as in Example 1. Color density was 1.08. Light resistance test was carried out in the same way as in Example 1. Color was developed by using the developer sheet. Color density was 1.07.

EXAMPLE 3

An electron accepting compound sheet was obtained in the same way as in Example 1 except that an equimolar adduct of zinc 3,5-bis-(α-methylbenzyl) salicylate and 3-{5-t-butyl-3-(2H-benzotriazole-2-yl)-4-hydroxyphenyl}propanol was used as the electron accepting compound. In the same way as in Example 1, color was developed. It was found that color density was 1.00. In the same way as in Example 1, the light resistance test of the developer sheet was carried out. The density of the developer sheet was measured. It was found that the density was 0.11. Further, color was developed by using the developer sheet. Color density was 0.98.

EXAMPLE 4

An electron accepting compound sheet was obtained in the same way as in Example 1 except that an equimolar adduct of zinc 3,5-di-t-octylsalicylate and 3-{5-t-butyl-3-(2H-benzotriazole-2-yl)-4-hydroxyphenyl}propionic acid was used as the electron accepting compound. Color was developed by using the electron donating colorless dye-containing microcapsule sheet of Example 2. Color density was 1.09. In the same way as in Example 1, the light resistance test of the developer sheet was carried out. The density of the developer sheet was 0.09. Further, color was developed by using the developer sheet. Color density was 1.08.

EXAMPLE 5

An electron donating colorless dye-containing microcapsule sheet was obtained in the same way as in Example 1 except that 2-anilino-3-methyl-6-N-ethyl-N-isoamylaminofluoran was used as the electron donating colorless dye. In the same way as in Example 1, color was developed. Color density was 0.98.

COMPARATIVE EXAMPLE 1

An electron accepting compound sheet was obtained in the same way as in Example 1 except that 12 parts of zinc 3,5-bis-α-methylbenzylsalicylate alone was used as the electron accepting compound. In the same way as in Example 1, color was developed. Color density was 1.01.

The light resistance test of the developer sheet was carried out. The density thereof was 0.20. Further, color was developed by using the developer sheet. Color density was 0.76.

COMPARATIVE EXAMPLE 2

An electron accepting compound sheet was obtained in the same way as in Example 1 except that a p-phenylphenol formalin condensate was used as the electron accepting compound. In the same way as in Example 1, color was developed. Color density was 0.88.

The light resistance test of the developer sheet was carried out. The density was 0.29.

It will be understood that the pressure-sensitive recording materials of the present invention have a high color density, the developer sheets of the present invention scarcely cause a change in color and a lowering in developing performance is small.

While the invention has been described in detail and with reference to specific embodiments thereof, it will be apparent to one skilled in the art that various changes and modifications can be made therein without departing from the spirit and scope thereof.

What is claimed is:

1. A recording material containing an electron donating colorless dye capable of undergoing a coloration reaction, wherein a metal salt of a salicylic acid, represented by the following formula (I), and a fatty acid having a benzotriazole group as a substituent group or an alcohol having a benzotriazole group as a substituent group, are provided on a same support:

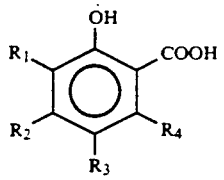

(I)

wherein $R_1$, $R_2$, $R_3$ and $R_4$ represent each hydrogen atom, an alkyl group or an aryl group.

2. A recording material as claimed in claim 1, wherein said salicylic acid derivative and said fatty acid derivative or alcohol derivative are present in the form of an adduct.

3. A recording material as claimed in claim 1 or 2, wherein said metal salt is a zinc salt.

4. A recording material as claimed in claim 1 or 2, wherein said fatty acid derivative or alcohol derivative is represented by formulas (II) and (III):

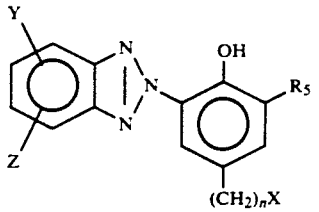

(II)

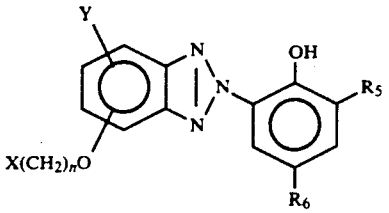

(III)

wherein n is an integer of 2 to 10; X is —COOH, —OH or $—COOC_mH_{2m-1}(OH)_2$, in which m is an integer of 3 to 10; Y and Z are each a hydrogen atom, an alkyl group, an alkoxy group, an aryloxy group, a halogen atom, a substituted amino group, a cyano group, a nitro group, an acyl group or a trihalomethyl group; and $R_5$ and $R_6$ are each a tertiary alkyl group.

5. A recording material as claimed in claim 1, which comprises a sheet comprising a support having provided thereon a microcapsule containing said electron donating colorless dye and a sheet comprising a support having provided thereon said salicylic acid derivative and said fatty acid derivative or alcohol derivative.

* * * * *